US008709169B2

(12) United States Patent
Company et al.

(10) Patent No.: US 8,709,169 B2
(45) Date of Patent: Apr. 29, 2014

(54) USE OF QUATERNARY AMMONIUM COMPOUND AS A HYDROTROPE AND A COMPOSITION CONTAINING THE QUATERNARY AMMONIUM COMPOUND

(71) Applicant: Akzo Nobel N.V., Arnhem (NL)

(72) Inventors: Mahnaz Company, Hisings Backa (SE); Kornelis Overkempe, Holten (NL); Adrianus Marinus Groenewegen, Zutphen (NL)

(73) Assignee: Akzo Nobel N.V., Arnhem (NL)

( * ) Notice: Subject to any disclaimer, the term of this patent is extended or adjusted under 35 U.S.C. 154(b) by 0 days.

(21) Appl. No.: 13/659,983

(22) Filed: Oct. 25, 2012

(65) Prior Publication Data

US 2013/0116163 A1 May 9, 2013

Related U.S. Application Data

(63) Continuation of application No. 11/795,003, filed as application No. PCT/EP2006/050269 on Jan. 18, 2006, now abandoned.

(60) Provisional application No. 60/653,178, filed on Feb. 15, 2005.

(30) Foreign Application Priority Data

Jan. 25, 2005 (EP) ..... 05075186

(51) Int. Cl.

| | |
|---|---|
| ***B08B 3/04*** | (2006.01) |
| ***C11D 1/44*** | (2006.01) |
| ***C11D 1/722*** | (2006.01) |
| ***C11D 1/835*** | (2006.01) |

(52) U.S. Cl.

USPC ..... 134/25.2; 134/25.3; 134/39; 134/41; 134/42; 510/264; 510/421; 510/433; 510/504; 510/506

(58) Field of Classification Search

CPC ..... B08B 3/04; C11D 1/44; C11D 1/722; C11D 1/835; C11D 3/044

USPC ..... 510/264, 421, 433, 504, 506; 134/25.2, 134/25.3, 39, 41, 42

See application file for complete search history.

(56) References Cited

U.S. PATENT DOCUMENTS

| | | | | |
|---|---|---|---|---|
| 4,284,435 | A | 8/1981 | Fox | |
| 4,895,667 | A | 1/1990 | Fox et al. | |
| 5,929,024 | A | 7/1999 | Stringer et al. | |
| 6,136,769 | A | 10/2000 | Asano et al. | |
| 6,156,712 | A | 12/2000 | Stringer et al. | |
| 6,462,014 | B1 | 10/2002 | Johnson et al. | |
| 2003/0064910 | A1 * | 4/2003 | Fong et al. | 510/421 |
| 2006/0019863 | A1 | 1/2006 | Hubig et al. | |

FOREIGN PATENT DOCUMENTS

| | | | |
|---|---|---|---|
| DE | 43 22 571 | A1 | 7/1994 |
| EP | 0 090 117 | A1 | 10/1983 |
| GB | 2 334 723 | A | 9/1999 |
| WO | WO 92/08823 | | 5/1992 |
| WO | WO 97/43364 | | 11/1997 |
| WO | WO 02/081610 | A1 | 10/2002 |
| WO | WO 03/016448 | A1 | 2/2003 |

OTHER PUBLICATIONS

International Search Report for International Application No. PCT/EP2006/050269, Apr. 3, 2006.

European Search Report for European Application No. EP 05075186, Jun. 28, 2005.

Derwent Abstract No. 0006847053 for German Patent Application No. DE4322571A1, Jul. 21, 1994.

Akzo Nobel, Safety Data Sheet, "Berol 556," pp. 1-5 (Mar. 21, 2005).

Akzo Nobel, Safety Data Sheet, "Berol 226," pp. 1-5 (Mar. 22, 2005).

CAS Registry No. 61791-10-4, "Quaternary ammonium compounds, coco alkylbis (hydroxyethyl)methyl, ethoxylated, chlorides," American Chemical Society, p. 1 (2000).

Graham Solomons, "Fundamentals of Organic Chemistry," Chapter 19 Amines, pp. 826-827 (1986).

STNEasy, CAS Registry No. 61788-46-3, pp. 1-2 (Sep. 6, 2005).

* cited by examiner

*Primary Examiner* — Brian P Mruk
(74) *Attorney, Agent, or Firm* — Sugiarto Hadikusumo

(57) ABSTRACT

The present invention relates to the use of an alkyl di(lower alkyl)mono(polyoxyethylene) quaternary ammonium compound as a hydrotrope in 5 aqueous solutions for a nonionic surfactant, preferably a C8-C18-alcohol alkoxylate containing 1-20 ethyleneoxy units and 0-5 propyleneoxy units. It also relates to a composition comprising said quaternary ammonium compound and said nonionic surfactant. The cationic surfactant has the formula 10 R2+R(1)N(CH2CH2O)n H X R1 wherein R=C6-C22 alkyl; R1 and R2 are independently a C1-C4 alkyl group; n=8-25; and X− is an anion. The compositions may be used for the cleaning of hard surfaces, for example for vehicle cleaning or machine dishwashing.

10 Claims, No Drawings

USE OF QUATERNARY AMMONIUM COMPOUND AS A HYDROTROPE AND A COMPOSITION CONTAINING THE QUATERNARY AMMONIUM COMPOUND

This application is a continuation of U.S. patent application Ser. No. 11/795,003, filed Jul. 10, 2007, now abandoned, which is a National Stage entry of International Application PCT/EP2006/050269, filed Jan. 18, 2006, which claims the benefit of U.S. Patent Application No. 60/653,178, filed Feb. 15, 2005, and European Patent Application No. 05075186.6, filed Jan. 25, 2005. The contents of the aforementioned applications are incorporated herein by reference in their entireties.

The present invention relates to the use of an alkyl di(lower alkyl)mono(polyoxyethylene) quaternary ammonium compound as a hydrotrope in aqueous solutions for a nonionic surfactant, preferably a $C_8$-$C_{18}$-alcohol alkoxylate containing 1-20 ethyleneoxy units and 0-5 propyleneoxy units. It also relates to a composition comprising said quaternary ammonium compound and said nonionic surfactant, and the use of this composition for the cleaning of hard surfaces.

The ability of an aqueous solution to spread evenly over a surface, the so-called wetting ability, is important for many applications. For example, a composition for the cleaning of hard surfaces benefits from a good wetting of the surface. Good wetting is also desirable for laundry as well as for scouring and mercerizing processes. Nonionic surfactants are known to be good wetting agents, and are often present in compositions for the cleaning of hard surfaces. Most often the hard surface cleaning composition will also contain alkaline components. Many nonionic surfactants are not soluble enough in aqueous solutions, especially with a high amount of electrolytes present, such as alkali hydroxides, alkaline builders and/or complexing agents, and therefore need the presence of a hydrotrope to improve their solubility. A good hydrotrope is not necessarily a good wetting agent. Its main task is to enhance the solubility of the nonionic surfactant and so increase the wetting ability of the composition, because the otherwise insoluble nonionic surfactant now is dissolved and can exert its wetting ability. A number of hydrotropes for nonionic surfactants have been described in various publications. Examples of such hydrotropes are ethanol, sodium xylene sulphonate, sodium cumene sulphonate, alkyl glycosides, and alkoxylated quaternary ammonium compounds.

In U.S. Pat. No. 4,284,435 a cleaning composition and a method for removing road film from transportation vehicles are disclosed. The composition comprises 2 to 30% by weight of chelating agent, 1 to 12% by weight of a bis(ethoxylated) quaternary ammonium compound, 0.5 to 5% by weight of an ethoxylated alcohol nonionic, 0-5% by weight of sodium metasilicate, and water. Suitable bis(ethoxylated) quaternary ammonium compounds have the formula

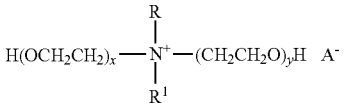

(A)

wherein R is methyl, ethyl or propyl, $R^1$ is an alkyl group having from 8 to 18 carbon atoms, an alkenyl group having from 8 to 18 carbon atoms or mixtures thereof, x and y are a number from 1 to 40, x+y is between 10 to 60, and $A^-$ is a water-soluble anion. A problem with these compounds is their poor biodegradability.

In WO 02/081610 quaternary ammonium compounds are described as hydrotropic co-surfactants. The compounds are preferably selected from the group of compounds represented by the following formula $$R^1R^2R^3R^4N^+X^- \quad (B)$$

wherein $R^1$ is a linear or branched, saturated or unsaturated $C_8$-$C_{22}$ alkyl group; $R^2$ is a $C_1$-$C_6$ alkyl group, or $R^1$; $R^3$ and $R^4$ are $C_2$-$C_4$ random or block polyoxyalkylene groups; and $X^-$ is an anion. A low-foaming cleaning formulation comprises at least one hydrotropic alkoxylated quaternary ammonium compound in combination with at least one nonionic surfactant based on an ethoxylated branched alcohol. These bisalkoxylated compounds are of the same type as (A), and consequently also have a poor biodegradability.

In US-A-2003/0064910 a non- or minimized streaking/filming anti-microbial hard surface cleaning formulation is disclosed containing a) an alkoxylated quaternary ammonium surfactant
b) an alkoxylated short chain nonionic surfactant
c) alkanolamine as an alkalinity source
d) an antimicrobial quaternary ammonium compound
e) at least one water-soluble or dispersible organic solvent having a vapor pressure of at least 0.001 mm Hg at 25° C.
f) the remainder, water In the description the most preferred alkoxylated quaternary ammonium surfactant is stated to be the cationic surfactant in Berol 226, which cationic surfactant is a bis(ethoxylated) quaternary ammonium compound according to formula A, and which consequently has a poor biodegradability. This compound is also used in all examples.

In U.S. Pat. No. 4,895,667 a composition capable of imparting softness and antistatic properties to fabrics treated therewith is described, the composition comprising the same types of compounds as disclosed in U.S. Pat. No. 4,284,435 in combination with a cationic long-chain monoalkyl quaternary ammonium compound. Compositions with nonionic surfactants are not disclosed or suggested.

In EP 0 090 117 A1 quaternary ammonium salts $R^1R^2R^3N^+(AO)_nH\ X^-$, wherein $R^1$ is a long-chain alkyl, $R^2$ and $R^3$ are short-chain alkyls, AO is alkylene oxide, $0<n\leq 30$, and $X^-$ is an anion, are used as the sole active component e.g. in fabric conditioning compositions.

U.S. Pat. No. 6,156,712 discloses a microemulsion all-purpose hard surface cleaning composition containing at least one surfactant, e.g., ethoxylated nonionics, alkyl sulfates or sulfonates, a quaternary ammonium complex which can be, e.g., an ethoxylated alkylamidoalkyl dialkylammonium salt or an ethoxylated trialkylammonium salt having a $C_6$ to $C_{18}$ alkyl group and 1-5 moles of ethyleneoxy units, at least one cosurfactant, and at least one water-insoluble organic compound; the balance being water. However, the ethoxylated trialkylammonium compounds are added as surfactants, not as hydrotropes, and the specific combinations of compositions as presently claimed are not disclosed.

WO 03/016448 discloses a mixed surfactant system comprising an anionic surfactant, a nonionic surfactant, and a cationic surfactant according to the following formula

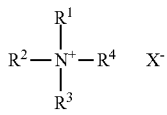

(C)

wherein $R_1$, $R_2$, $R_3$ and $R_4$ independently or simultaneously are $C_1$-$C_{20}$ saturated or unsaturated chain groups, benzyl groups, hydroxyl ethyl groups or hydroxyl ethyl groups to which 1 to 20 ethylene oxide groups or propylene oxide groups are attached; and X is a halogen atom, a sulfate group, or an acetate group. In the description ethoxylated trialkylammonium salts having $C_1$ to $C_{20}$ alkyl groups and 1-20 moles of ethyleneoxy units are exemplified, e.g. the synthesis of ethoxylated N-(dimethyldodecylamino)ethanol chloride is described. In all compositions comprising the cationic surfactant, the molar amount of cationic groups of the surfactant is less than the molar amount of anionic groups of the anionic surfactant.

U.S. Pat. No. 6,136,769 discloses similar cleaning compositions to those described above, containing anionic surfactants such as alkyl sulfate and alkyl benzene sulfonate in combination with cationic surfactants of the formula

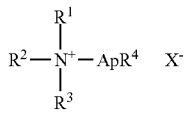

(D)

wherein $R^1$ is an alkyl or alkenyl moiety containing 8-18 carbon atoms, $R^2$ and $R^3$ independently are alkyl groups containing from 1 to 3 carbon atoms, $R^4$ is hydrogen, methyl or ethyl, A is selected from $C_1$-$C_4$ alkoxy, p is 2-30, and $X^-$ is an anion; in addition the compositions can also contain nonionics, such as alkoxylated alcohols, alkyl polyglucosides or polyhydroxy fatty acid amides. The weight ratio of the cationic surfactants (D) to other surfactants present in the compositions is low. In the case of anionic surfactants, these were added in molar excess with regard to the cationic surfactants. The preferred compounds in U.S. Pat. No. 6,136,769 are outside the claimed range of the present invention. Furthermore, the molar amounts are such that effectively all cationic surfactants are complexed by anionic surfactants.

The aim of the present invention is to find a new hydrotrope that is efficient in making clear homogeneous concentrated compositions containing a non-ionic surfactant, preferably a nonionic alkylene oxide adduct, more preferably a $C_8$-$C_{18}$-alcohol alkoxylate comprising 1-20 ethyleneoxy units and 0-5 propyleneoxy units, and where the cleaning performance of the compositions is good. Also these hydrotropes should have better biodegradability than the previously known bisethoxylated quaternary ammonium compounds.

It has now surprisingly been found that cationic surfactants having the formula

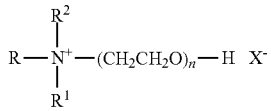

(1)

wherein R═$C_6$-$C_{22}$ hydrocarbyl, preferably $C_6$-$C_{22}$ alkyl or alkenyl, more preferably $C_8$-$C_{20}$ alkyl or alkenyl, and most preferably $C_{10}$-$C_{18}$ alkyl or alkenyl; $R^1$ and $R^2$ independently are $C_1$-$C_4$ alkyl, preferably methyl or ethyl, and most preferably both $R^1$ and $R^2$ are methyl; n is at least 8, preferably at least 9, and most preferably at least 10, and at most 25, preferably at most 20, and most preferably at most 17; and $X^-$ is an anion, e.g. halide or methylsulfate, are very efficient hydrotropes for nonionic surfactants, are better biodegradable than conventional bisethoxylated quaternary ammonium compounds, and also aid in the cleaning performance of compositions where they are present in combination with nonionic surfactants. Nonionic surfactants that are preferably used according to the invention, because the effect of the hydrotrope is best observed, are the nonionic alkylene oxide adducts. These nonionic alkylene oxide adducts are well known conventional products wherein the molecule comprises a hydrophobic moiety and a moiety containing alkyleneoxy units, said latter moiety having a hydrophilic character. Thus the invention relates to the use of compounds of formula 1 as hydrotropes for nonionic surfactants in aqueous solutions. In other words, the invention relates to the improved solubilization of nonionic surfactants to make compositions with a good cleaning performance wherein water, a nonionic surfactant, a cationic hydrotrope having the formula (1) as defined above, and other optional ingredients are combined and/or mixed in one or several steps. The invention also relates to the use of such compositions in the cleaning of surfaces, preferably hard surfaces.

The invention further relates to aqueous compositions comprising a) a non-ionic surfactant, preferably a nonionic alkylene oxide adduct, more preferably a $C_8$-$C_{18}$-alcohol alkoxylate containing 1-20 ethyleneoxy units and 0-5 propyleneoxy units and b) a cationic hydrotrope having the formula (1) as defined above, with the proviso that if any anionic and/or amphoteric surfactant is present in the composition, then the molar amount of cationic hydrotrope of formula (1) is greater than the molar amount of any anionic groups that are being part of an anionic and/or amphoteric surfactant. By this is meant that the anionic groups are covalently bound within the anionic or the amphoteric surfactant; e.g. a sulphate group of an alkyl sulphate having the formula $R—OSO_3^-A^+$, where R is an hydrocarbyl group with at least 6 carbon atoms, is covalently bound to the hydrocarbyl group R, and these groups together constitute the anionic surfactant. Counterions, such as $X^-$ in formula I, e.g. $CH_3OSO_3^-$, are not to be taken into account in this context. If any anionic and/or amphoteric surfactant is present in the composition, the molar ratio of anionic groups of the surfactant to cationic surfactant of formula (1) is less than 1:1, preferably less than 1:2, and more preferably less than 1:3. Most preferably, the aqueous composition is free of anionic and amphoteric surfactants.

In the absence of anionic and amphoteric surfactants, the molar ratio between nonionic and cationic surfactant suitably is 1:2 to 12:1, preferably 1:1 to 10:1, more preferably 2:1 to 8:1, and most preferably 2.5:1 to 7:1. When the formulation is acidic, less hydrotrope is required, and the molar ratio is preferably 2.5:1 or higher. An acidic formulation preferably has a pH of 5 or lower.

When anionic and/or amphoteric surfactants are present in the composition, then the cationic surfactant is to be used in an amount large enough to ensure that the molar ratios of the nonionic surfactant and non-complexed cationic surfactant are within the ranges disclosed above.

Optionally, the compositions can further comprise c) alkali hydroxides, alkaline builders and/or alkaline complexing agents.

The amounts of the components are suitably a) at least 0.05% by weight, preferably at least 0.5% by weight, and at most 20% by weight, preferably at most 15% by weight, and most preferably at most 10% by weight, of alcohol alkoxylate b) at least 0.02% by weight, preferably at least 0.1% by weight, and at most 20% by weight, preferably at most 15% by weight, and most preferably at most 10% by weight, of cationic hydrotrope, and c) 0% by weight, preferably at least 0.05% by weight, and at most 40% by weight, preferably at most 30% by weight, more preferably at most 20% by weight, and most preferably at most 15% by weight, of alkali hydroxides, alkaline builders and/or alkaline complexing agents.

It is especially preferred that the compositions contain alkali hydroxides, alkaline builders and/or alkaline complexing agents.

The compositions are excellent for use in cleaning hard surfaces, such as for vehicle cleaning and machine dishwashing.

The compounds of formula I may be obtained by different processes, the most convenient being the ethoxylation of a secondary alkyl methylamine or alkyl ethylamine, followed by quaternization of the resulting tertiary amine with, e.g., a $C_1$-$C_4$ alkyl halide, e.g. methyl or ethyl chloride, as described in EP 0 090 117 A1. Suitable secondary amine starting compounds are n-octyl methylamine, 2-ethylhexyl methylamine, n-decyl methylamine, 2-propylheptyl methylamine, cocoalkyl methylamine, lauryl methylamine, $C_{16/18}$ alkyl methylamine, oleyl methylamine, rape seed alkyl methylamine, soya alkyl methylamine, tallow alkyl methylamine, tetradecyl methylamine, hexadecyl methylamine, and octadecyl methylamine. Optionally, other alkyleneoxy groups may be added to the secondary amine in addition to the ethyleneoxy groups. The alkyleneoxy groups may be added randomly or in blocks. Preferably, only ethyleneoxy groups are added. A preferred product is (coco alkyl) dimethyl mono (polyoxyethylene) quaternary ammonium chloride which contains 15 moles of EO.

The nonionic surfactants preferably have the formula $$R_3O—(PO)_x(EO)_y(PO)_zH \quad (2)$$

wherein $R_3$ is a $C_8$ to $C_{18}$ alkyl group, preferably $C_8$ to $C_{12}$; PO is a propyleneoxy unit, EO is an ethyleneoxy unit, x=0-5, preferably 0-4, and most preferably 0-2; y=1-20, preferably 1-12, more preferably 2-8, and most preferably 2-5; and z=0-5, preferably 0-4, more preferably 0-2, and most preferably 0. Thus, in addition to the 1-20 ethyleneoxy units, the $C_8$-$C_{18}$-alcohol alkoxylates may also contain up to 5 propyleneoxy units. The number of propyleneoxy units, when present, may be as small as 0.1 mole PO per mole alcohol. The ethyleneoxy units and the propyleneoxy units may be added randomly or in blocks. The blocks may be added to the alcohol in any order. The alkoxylates may also contain an alkyl group with 1-4 carbon atoms in the end position. Preferably, the alkoxylates contain 2-8 ethyleneoxy units and 0-2 propyleneoxy units. The alkyl group of the nonionic surfactants may be linear or branched, saturated or unsaturated. Suitable linear nonionic surfactants are $C_9$-$C_{11}$ alcohol+4, 5 or 6 moles of EO, $C_{11}$ alcohol+3, 4, 5, 6, 7 or 8 moles of EO, tridecyl alcohol+4, 5, 6, 7 or 8 moles of EO, and $C_{10}$-$C_4$ alcohol+8 moles of EO+2 moles of PO. Suitable branched nonionic surfactants are 2-ethylhexanol+3, 4 or 5 moles of EO, 2-ethylhexanol+2 moles of PO+4, 5 or 6 moles of EO, 2-propylheptanol+3, 4, 5 or 6 moles of EO and 2-propylheptanol+1 mole of PO+4 moles of EO. Another example is 2-butyloctanol+5, 6 or 7 moles of EO. Wherever the degree of alkoxylation is discussed, the numbers represent molar average numbers.

The compositions may be acidic, neutral or alkaline. Alkaline compositions are typically based on alkali hydroxides, alkaline builders and/or complexing agents. The alkaline compositions are especially preferred.

The alkali hydroxides preferably are sodium or potassium hydroxide. The alkaline builders may be an alkali carbonate or an alkali hydrogen carbonate, such as sodium carbonate, potassium carbonate, sodium hydrogen carbonate or potassium hydrogen carbonate, an alkali salt of a silicate, such as sodium silicate or sodium metasilicate, or alkali salts of phosphates, such as sodium orthophosphate. Alkaline builders which act through complexation are, e.g., sodium pyrophosphate and sodium tripolyphosphate and the corresponding potassium salts. The builder/complexing agent may also be organic. Examples of organic builders/complexing agents are aminocarboxylates, such as sodium nitrilotriacetate ($Na_3NTA$), sodium ethylenediamine tetraacetate (EDTA), sodium diethylenetriamine pentaacetate, sodium 1,3-propylenediamine tetraacetate, and sodiumhydroxyethylethylenediamlne triacetate; aminopolyphosphonates, such as nitrilotrimethylene phosphonate; organic phosphates; polycarboxylates, such as citrates; and alkali salts of gluconic acid, such as sodium or potassium gluconates.

In neutral and acidic compositions complexing agents may also be added, such as citric acid.

The concentrated compositions of the present invention are clear and stable. The clarity interval suitably is between 0-40° C., preferably between 0-50° C., and most preferably between 0-60° C. This may be adapted by changing the ratio of hydrotrope to nonionic surfactant. The concentrate normally contains at least 50% by weight of water, suitably at least 70% by weight, and normally at most 95% by weight of water, suitably at most 90% by weight.

There are several advantages connected with the use of the cationic surfactants of formula (I) as hydrotropes for nonionic surfactants. Firstly, they are excellent hydrotropes that also contribute to the cleaning performance of the compositions. Their cleaning efficiency is very good even at high dilutions of the compositions. Further, their biodegradability was found to be better than that of previously known bis(ethoxylated) quaternary ammonium compounds used in compositions for cleaning hard surfaces.

Aqueous cleaning compositions comprising the hydrotrope and the surfactant in accordance with the invention may contain the usual additives, such as (but not limited to) perfumes, pH buffers, abrasives, opacifiers, disinfectants, deodorants, colorants and rheology modifiers in the usual amounts.

The present invention is further illustrated by the following Examples.

General

A compound of formula 1 was prepared in the following way, wherein the term "bar a" means the absolute pressure.

Ethoxylation Reaction

To 265.2 g (1.27 moles) of monomethyl mono-($C_{12}$-$C_{14}$-alkyl)amine, heated at 170° C. in a stainless steel autoclave that had been evacuated, 57.0 g (1.27 moles) of ethylene oxide were added with stirring during a period of 40 minutes. The temperature was kept at 170° C. during the addition, and the maximal pressure was 4.5 bar a. After the addition, the reaction mixture was kept at this temperature for 1 h. Then the temperature was lowered to 100° C., and 0.8 g KOH dissolved in methanol was added. The methanol and water were evaporated off at approximately 0.2 bar a at a temperature of 100-170° C., after which ethylene oxide was added at 170° C. in the appropriate amount to obtain the desired degree of ethoxylation. The maximal pressure during the addition was 4.5 bar a, and after the addition the reaction mixture was kept at this temperature until a steady pressure was obtained.

Quaternization Reaction

The ethoxylated product obtained in the previous step was heated to 85-90° C. and an equimolar amount of methyl chloride was added with stirring during 5-10 minutes. The reaction was exothermic, and the temperature rose to 105-110° C. The maximal pressure during the reaction was 3.0-3.2 bar a. After about 15 minutes the pressure was 1 bar a at 110° C., and the stirring and heating was continued for 1 h.

This example describes the ethoxylation and quaternization of monomethyl mono-($C_{12}$-$C_{14}$-alkylamine. The equivalent process may generally be used for the synthesis of all of the cationic hydrotropes of the present invention. This is Just a suitable example of a process for making these compounds; they may also be obtained by a number of other processes.

EXAMPLE 1

In this and all following examples all percentages are by weight, unless otherwise specified.

Formulations with the reagents specified in Table 1 were made. The cationic hydrotrope was added in such an amount that the solution exhibited the clarity interval stated.

The cationic compound (cocoalkyl)amine+17 EO quaternized by $CH_3Cl$ that was used in comparison formulation A has the structural formula

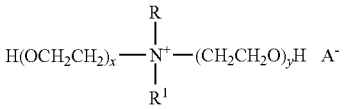

(A)

wherein R=cocoalkyl, $R^1$=methyl, $\Sigma(x+y)=17$, and $A^-$ is $Cl^-$.

TABLE 1

| Ingredient | A (Comp.)[1] | I | II | III |
|---|---|---|---|---|
| $C_9$-$C_{11}$-alcohol + 4EO[2] | 5% | 5% | 5% | 5% |
| (Coco alkyl)amine + 17EO quaternized by $CH_3Cl$ | 3% | | | |
| Monomethyl mono-($C_{12}$-$C_{14}$-alkyl)amine + 15EO quaternized by $CH_3Cl$ | | 3% | 2.4% | 2.4% |
| Sodium metasilicate | 4% | 4% | | |
| Tetrapotassium pyrophosphate | 6% | 6% | 10% | 6% |
| Water | Balance | Balance | Balance | Balance |
| Clarity interval ° C. | 0-56 | 0-52 | 0-52 | 0-60 |

[1]Comparative formulation
[2]Narrow range ethoxylate

To evaluate the cleaning efficiency of some of the formulations in Table 1 at different dilutions the following cleaning test was used: White-painted plates were smeared with an oil-soot mixture obtained from train diesel engines. 25 ml of the test solutions, in this case formulations A and I in Table 1 diluted to 1:40, 1:60, and 1:100, were poured onto the top of the oil-smeared plates and left there for one minute. The plates were then rinsed off with a rich flow of water. All solutions and the water were kept at a temperature of about 15-20° C. All comparison solutions were placed on the same plates as the test solutions. The cleaning ability was measured with a Minolta Chroma Meter CR-200 reflectometer, and the result is presented as the % soil removal. The results are collected in Table 2.

Note that the values given are to be used only as relative, not absolute values. The values to be compared should be obtained from the same plates with the same batch of oil-soot mixture being used. Where nothing else is stated, the values are the average results of tests performed on at least two plates. The accuracy is about ±5%.

TABLE 2

| Formulation | Soil removal at 1:40 dilution (%) | Soil removal at 1:60 dilution (%) | Soil removal at 1:100 dilution (%) |
|---|---|---|---|
| A | 86** | 65* | 23* |
| I | 82** | 73* | 43* |

*Based on the results of 4 tests on 4 plates
**Based on the results of 5 tests on 5 plates Formulation (I), containing the hydrotrope according to the invention, was more effective in cleaning the plates at the high dilutions 1:60 and 1:100 than comparison formulation A.

EXAMPLE 2

In this example further formulations were made with the reagents specified in Table 3 to compare products with different amounts of ethyleneoxy groups. Also a non-quaternized product was investigated. The cationic hydrotrope was added in such an amount that the solution exhibited the clarity interval stated.

TABLE 3

| Ingredient | B[1] | C[1] | IV | V | VI | VII |
|---|---|---|---|---|---|---|
| $C_9$-$C_{11}$-alcohol + 4EO[2] | 5% | 5% | 5% | 5% | 5% | 5% |
| Monomethyl mono-($C_{12}$-$C_{14}$-alkyl)amine + 15EO[3] | >16% | | | | | |
| Monomethyl mono-($C_{12}$-$C_{14}$-alkyl)amine + 5EO quaternized by $CH_3Cl$ | | 2.5% | | | | |
| Monomethyl mono-($C_{12}$-$C_{14}$-alkyl)amine + 10EO quaternized by $CH_3Cl$ | | | 2.5% | | 2% | |
| Monomethyl mono-($C_{12}$-$C_{14}$-alkyl)amine + 15EO quaternized by $CH_3Cl$ | | | | 3.5% | | 2.5% |
| Sodium metasilicate | 4% | 4% | 4% | 4% | | |

TABLE 3-continued

| Ingredient | B[1] | C[1] | IV | V | VI | VII |
|---|---|---|---|---|---|---|
| Tetrapotassium pyrophosphate | 6% | 6% | 6% | 6% | | |
| Trisodium nitrilotriacetate | | | | | 6% | 6% |
| Water | Bal. | Bal. | Bal. | Bal. | Bal. | Bal. |
| Clarity interval ° C. | | 0-70 | 0-54 | 0-60 | 0-63 | 0-70 |

[1]Comparative formulation
[2]Narrow range ethoxylate
[3]This product has not been quaternized, and is not working as a hydrotrope even when more than 16% has been added

TABLE 4

| Formulation | Soil removal at 1:40 dilution (%) |
|---|---|
| C[1] | 3 |
| IV | 57 |
| V | 79* |
| VI | 82 |
| VII | 85 |

[1]Comparative formulation
*Average of 4 tests on 4 plates

The amount of ethyleneoxy units of the hydrotrope is important for the cleaning performance of the formulations. If all other ingredients are the same, for hydrotrope compounds having the same alkyl chain length, the compounds with the larger amounts of ethyleneoxy units give compositions exhibiting better cleaning performance.

EXAMPLE 3

In this example concentrates containing hydrotrope, nonionic surfactant, and propylene glycol are formulated. These concentrates are then used to make alkaline cleaning compositions, which are diluted and tested for cleaning performance using the same general procedure as described in Example 1.

TABLE 5

| Ingredient | VIII | IX |
|---|---|---|
| $C_9$-$C_{11}$-alcohol + 4EO[2] | 50% | 50% |
| Monomethyl mono-($C_{12}$-$C_{14}$-alkyl)amine + 10EO quaternized by $CH_3Cl$ | 30% | |
| Monomethyl mono-($C_{12}$-$C_{14}$-alkyl)amine + 15EO quaternized by $CH_3Cl$ | | 30% |
| Propylene glycol | 20% | 20% |

[2]Narrow range ethoxylate

TABLE 6

| Ingredient | X | XI |
|---|---|---|
| Formulation VIII | 10% | |
| Formulation IX | | 10% |
| Sodium metasilicate | 4% | 4% |
| Tetrapotassium pyrophosphate | 6% | 6% |
| Water | Balance | Balance |

TABLE 7

| Formulation | Soil removal at 1:3 dilution (%) | Soil removal at 1:100 dilution (%) |
|---|---|---|
| X | 91 | 78 |
| XI | 93 | 87 |

TABLE 8

| Ingredient | XII | XIII |
|---|---|---|
| Formulation VIII | 10% | |
| Formulation IX | | 10% |
| Tetrapotassium pyrophosphate | 6% | 6% |
| Water | Balance | Balance |

TABLE 9

| Formulation | Soil removal at 1:1 dilution (%) | Soil removal at 1:5 dilution (%) | Soil removal at 1:10 dilution (%) | Soil removal at 1:200 dilution (%) |
|---|---|---|---|---|
| XII | 60 | 54 | 47 | 46 |
| XIII | 80 | 78 | 76 | 51 |

Also at high dilutions the formulations according to the invention exhibit a good soil removal. Here again it is demonstrated that for hydrotropes having the same alkyl chain length, the compounds with the higher amounts of ethyleneoxy units make a better contribution to the cleaning performance.

EXAMPLE 4

In this example further formulations with cationic hydrotropes having different alkyl chain lengths and different amounts of EO are displayed, and for some of the formulations the cleaning performance is demonstrated in Table 11.

TABLE 10

| Ingredient | XIV | XV | XVI | XVII | XVIII | XIX |
|---|---|---|---|---|---|---|
| $C_9$-$C_{11}$-alcohol + 4EO[2] | 5% | 5% | 5% | 5% | 5% | 5% |
| Monomethyl mono-($C_{16}$-$C_{18}$-alkyl)amine + 15EO quaternized by $CH_3Cl$ | 4% | 3.5% | | | | |
| Monomethyl mono-($C_{12}$-$C_{14}$-alkyl)amine + 15EO quaternized by $CH_3Cl$ | | | 2.5% | | | 3% |

TABLE 10-continued

| Ingredient | XIV | XV | XVI | XVII | XVIII | XIX |
|---|---|---|---|---|---|---|
| Monomethyl mono-n-octylamine + 10EO quaternized by $CH_3Cl$ | | | | 6% | 6% | |
| Sodium metasilicate | | | | 4% | | |
| Tetrapotassium pyrophosphate | 10% | | 10% | 6% | | |
| Trisodium nitrilotriacetate | | 10% | | | 6% | 10% |
| Water | 81 | 81.5 | 82.5 | 79 | 83 | 84 |
| Clarity interval ° C. | 0-51 | 0-53 | 0-47 | 0-57 | 0-45 | 0-64 |

[2]Narrow range ethoxylate

TABLE 11

| Formulation | Alkyl chain length | Amount of EO (moles per mole alcohol) | Soil removal at 1:40 dilution (%) | Soil removal at 1:80 dilution (%) |
|---|---|---|---|---|
| XVI | $C_{12-14}$ | 15 | 73 | 65 |
| XIV | $C_{16-18}$ | 15 | 62 | 63 |
| IV | $C_{12-14}$ | 10 | 57[4] | |
| XVII | $C_8$ | 10 | 45 | 32 |

[4](value from Table 4)

This example shows that cationic compounds according to formula 1 having different combinations of the amount of ethyleneoxy units and the alkyl chain length all work as hydrotropes. When comparing compounds with the same amount of ethyleneoxy units but with different alkyl chain lengths, they exhibit a comparable contribution to the cleaning performance of the respective formulations.

EXAMPLE 5

This example comprises hydrotropes obtained with butyl bromide and dimethyl sulfate as quaternizing agents.

TABLE 12

| Ingredient | XX | XXI |
|---|---|---|
| $C_9$-$C_{11}$-alcohol + 4EO[2] | 5% | 5% |
| Monomethyl mono-($C_{12}$-$C_{14}$-alkyl)amine + 15EO quaternized by BuBr | 5% | |
| Monomethyl mono-($C_{12}$-$C_{14}$-alkyl)amine + 15EO quaternized by dimethyl sulfate | | 6% |
| Sodium metasilicate | 4% | 4% |
| Tetrapotassium pyrophosphate | 6% | 6% |
| Water | balance | balance |
| Clarity interval ° C. | 0-44 | 0-41 |

[2]Narrow range ethoxylate

TABLE 13

| Formulation | Soil removal at 1:20 dilution (%) | Soil removal at 1:40 dilution (%) | Soil removal at 1:60 dilution (%) |
|---|---|---|---|
| XX | 88 | 82 | 82 |
| XXI | 88 | 87 | 85 |
| A[1] | 86 | 80 | 67 |

[1]Comparative formulation

These compounds also work as hydrotropes and contribute to the cleaning performance at 1:60 dilution to the same degree as they do at 1:20 dilution.

EXAMPLE 6

The biodegradability of N—($C_{12}$-$C_{14}$-alkyl)-N,N-dimethyl-N-polyoxyethylene(15)ammonium chloride (=monomethyl mono-($C_{12}$-$C_{14}$-alkyl)amine+15EO quaternized by $CH_3Cl$) was determined by the Closed Bottle test (OECD 301 D), performed according to slightly modified EEC, OECD and ISO Test Guidelines (OECD, 1992; EEC 1984; ISO, 1994) in compliance with the OECD principles of Good Laboratory Practice, to be 63% at day 28. Hence this compound should be classified as readily biodegradable. As a comparison, the N-(tallow alkyl)-N-methyl-N,N-di(polyoxyethylene)(15)ammonium chloride has an approximate biodegradation at day 28 of 20% (see "Biodegradation of surfactants" edited by D. R. Karsa and M. R. Porter, Blackie Academic & Professional, 1995, Chapter 6, page 189).

What is claimed is:

1. A method of cleaning hard surfaces which comprises applying to said surfaces a cleaning effective amount of an aqueous composition comprising a nonionic surfactant in an aqueous media, the solubility of said nonionic surfactant in said aqueous media having been increased by adding to said nonionic surfactant and/or aqueous media a hydrotrope for said nonionic surfactant, said hydrotrope comprising a cationic surfactant having the formula

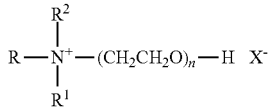

(1)

wherein R=$C_8$-$C_{20}$ alkyl or alkenyl; $R^1$ and $R^2$ independently are a $C_1$-$C_4$ alkyl group; n=15-25; and $X^-$ is an anion, and said nonionic surfactant is a $C_8$-$C_{18}$-alcohol alkoxylate containing 1-20 ethyleneoxy units and 0-5 propyleneoxy units, and said aqueous media comprises alkali hydroxides, alkaline builders and/or alkaline complexing agents, with the proviso that if any anionic and/or amphoteric surfactant is present in the composition, then the molar amount of the cationic hydrotrope is greater than the molar amount of any anionic groups in the anionic and/or amphoteric surfactant.

2. The method of claim 1 wherein $R^1$ and $R^2$ are methyl and $X^-$ is a halide ion or a methylsulfate ion.

3. The method of claim 1 wherein n=15-17.

4. The method of claim 1 wherein an alcohol alkoxylate is present of the formula $$R^3O—(PO)_x(EO)_y(PO)_zH \quad (2)$$

wherein $R^3$ is a $C_8$ to $C_{18}$ alkyl group, PO is a propyleneoxy unit, EO is an ethyleneoxy unit, x=0-4, y=1-20, and z=0-4.

5. The method of claim 1 wherein in said aqueous composition the molar ratio of anionic groups in the anionic and/or the amphoteric surfactant to cationic hydrotrope is less than 1:2.

6. The method of claim 1 wherein in said aqueous composition the molar ratio of anionic groups to cationic hydrotrope is less than 1:3.

7. The method of claim 1 wherein said aqueous composition is free of anionic and amphoteric surfactants.

8. The method of claim 1 wherein said aqueous composition comprises a) 0.05-20% by weight of the alcohol alkoxylate and b) 0.02-20% by weight of the cationic hydrotrope.

9. The method of claim 8 wherein said aqueous composition further comprises c) 0.05-40% by weight of alkali hydroxides, alkaline builders and/or alkaline complexing agents.

10. The method of claim 1, wherein R=$C_{10}$-$C_{18}$ alkyl or alkenyl.

* * * * *